US005132490A

United States Patent [19]

Aldissi

[11] Patent Number: 5,132,490

[45] Date of Patent: Jul. 21, 1992

[54] CONDUCTIVE POLYMER SHIELDED WIRE AND CABLE

[75] Inventor: Mahmoud Aldissi, Colchester, Vt.

[73] Assignee: Champlain Cable Corporation, Winooski, Vt.

[21] Appl. No.: 695,140

[22] Filed: May 3, 1991

[51] Int. Cl.[5] ..... H01B 7/34

[52] U.S. Cl. ..... 174/36; 174/106 SC; 174/109

[58] Field of Search ..... 174/36, 106 R, 106 SC, 174/109

[56] References Cited

U.S. PATENT DOCUMENTS

| | | | |
|---|---|---|---|
| 3,660,592 | 5/1972 | Anderson | 174/36 X |
| 4,096,346 | 6/1978 | Stine et al. | 174/36 |
| 4,301,428 | 11/1981 | Moyer | 174/36 X |
| 4,347,487 | 8/1982 | Martin | 174/36 X |
| 4,383,225 | 5/1983 | Mayer | 174/36 |
| 4,486,721 | 12/1984 | Cornelius et al. | 174/36 |
| 4,487,996 | 12/1984 | Rabinowitz et al. | 174/105 R |
| 4,556,860 | 12/1985 | Tobias et al. | 174/17.05 X |
| 4,871,883 | 10/1989 | Guiol | 174/36 |
| 4,965,412 | 10/1990 | Lai et al. | 174/106 SC |

*Primary Examiner*—Morris H. Nimmo
*Attorney, Agent, or Firm*—Salzman & Levy

[57] ABSTRACT

The present invention features a shielded wire and cable article capable of operating more effectively in high power environments. The article generally comprises an inner conductive core of one or more wires that can be twisted or braided and which can be individually insulated. The conductive core is surrounded by one or more thin layer(s) of insulation about which conventional, braided or served mesh shielding is applied. The shielding effectiveness is improved in accordance with this invention by the addition of a layer of conductive polymer material above or below the braided or served mesh.

22 Claims, 3 Drawing Sheets

CONDUCTIVE POLYMER SHIELDED WIRE AND CABLE

FIELD OF THE INVENTION

The invention relates to shielded wire and cable, and more particularly to an improved shielded wire and cable article that is more effective in a higher frequency range than conventional shielded wire and cable articles.

BACKGROUND OF THE INVENTION

Advanced technological uses for wire and cable has imposed many new requirements upon traditional wire and cable specifications and functions. In high power shielded cable environments with corona effects for example, there is a need for shielded cable that can operate more efficiently and effectively at higher frequencies.

Shielded wire and cable is often required to meet stringent shielding specifications when utilized in missiles or aircraft. Such wire and cable articles often have to operate in radiation and electrical interference fields without compromising the on-board electronics.

Presently, wire and cables are shielded electrically by braiding wire mesh shields disposed about the primary wire core and insulation. This shielding is meant to prevent RFI and EMI disturbances from influencing the signals in the cable.

As the advanced technology requirements impose greater stringency in shielding frequency specifications, these previously functional braided articles become unacceptable. Shielding leakages occur in these conventional cables by virtue of the looseness by which the wire mesh is braided, leaving holes in the shield web. In addition, the stiffness of the metal wire used in braiding makes it difficult to conform the mesh to the insulation core surfaces, leaving small gaps. Such gaps limit the frequency range in which the cable or wire can be operationally effective.

In high power environments, shorts pose a particular hazard when utilizing shielded cable.

The present invention has resolved the aforementioned problems by the development of a new type of shielded wire and cable article. The new article of this invention contemplates the use of shielding composed of conductive polymer tape wraps or an extruded conductive polymer layer that is utilized in conjunction with the braided mesh shield. The conductive polymer materials provide a homogeneous layer that complements the standard metal wire mesh braiding. The homogeneity of the conductive polymer layer reduces interference leakage and contributes to a higher shielding frequency range capability.

Generally, the conductive polymer layer is combined above or below conventional braided mesh shields. The conductive polymer can be applied as a jacket layer over the conventional wire mesh shield layer. The two combined shield layers will improve the shielding effectiveness in the EMI region at frequencies higher than 10 MHz. The transfer impedance of the inventive cable can range from approximately 0.08 ohm/meter to about 0.5 ohm/meter at 1 GHz.

SUMMARY OF THE INVENTION

In accordance with the present invention, there is provided a shielded wire and cable article capable of operating more effectively in high power environments.

The article generally comprises an inner conductive core of one or more wires that can be twisted or braided, and which can be individually insulated. The conductive core is surrounded by one or more thin layer(s) of insulation about which conventional, braided or served mesh shielding is applied. The shielding effectiveness is improved in accordance with this invention by the addition of a layer of conductive polymer material above or below the braided or served mesh.

The shielding effectiveness (improved operational frequency range) of the resulting inventive wire and cable article generally results in a range above approximately 10 MHz. The surface transfer impedance of the shielded wire and cable of the invention is approximately in a range between 0.05 to 0.5 ohm/meter over a respective frequency range of from 10 MHz to 1 GHz.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the present invention features a shielded wire and cable article whose shielding is fabricated from the combination of braided or served wire mesh and conductive, or semi-conductive polymer layers. The shielding layers of the invention provides improved shielding effectiveness at high frequency ranges above 10 MHz.

Figure 1:
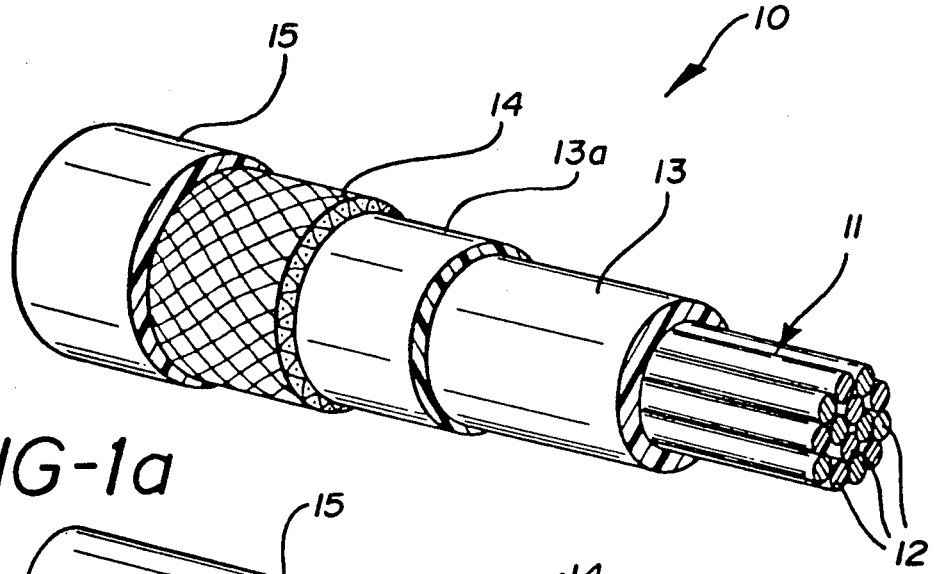
FIG. 1 is a schematic, cutaway, perspective view of the shielded wire or cable article of this invention.

Now referring to FIG. 1, a typical shielded wire or cable article 10 of this invention is illustrated in schematic, cutaway perspective view. The inner, electrically conductive core 11 of the wire or cable 10 is composed of one or more metallic wires 12, usually of copper. The wires 12 can be straight, twisted or braided, as is conventionally known in the art, and may be bare or individually insulated. The conductive core 11 is covered by one or more thin insulation layer(s) 13, and 132 which insulation can be any suitable material as befits the utility and specifications sought to be met. One of the insulation layers 13 may be a conductive, or semi-conductive polymer layer, in accordance with the invention.

About the insulation layer(s) 13, a conventional shielding layer 14 of wire mesh is overlaid. The shielding layer 14 can be applied as a braided or served mesh of wire. Over the shield layer 14 is generally disposed one or more jacket layers 15 of the conductive or semi-conductive polymer, in accordance with this invention. The jacket layer(s) 15 can be any number of conductive polymer materials befitting the intended purposes and specifications designated for the final cable product.

Figure 1A:
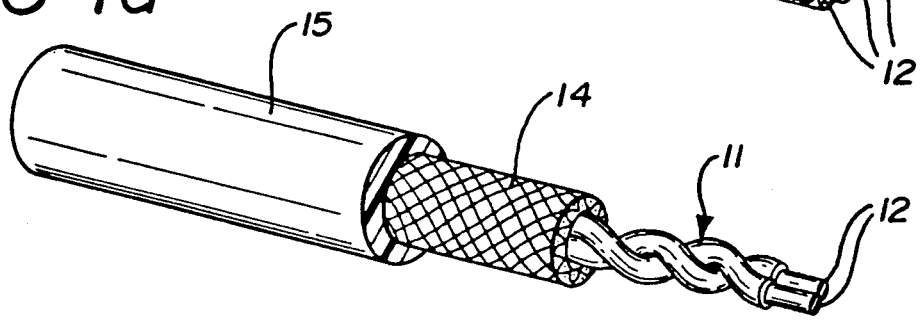
FIG. 1*a* is a schematic, cutaway, perspective view of an alternate embodiment of the shielded cable article of the invention, wherein the cable forms a twin pair.

Referring to FIG. 1*a*, an alternate embodiment of the cable 10 shown in FIG. 1 illustrates a twin cable construction for the shielded article of this invention.

The conductive polymer layer 15 can be applied as a tape wrap, or it can be extruded. A typical conductive polymer tape wrap comprises a polyaniline-based conducting polymer formulated by Americhem/Allied Signal Corp.

Shielded wire and cable articles were fabricated in accordance with this invention, as described below in the following examples.

EXAMPLE 1

Figure 2:
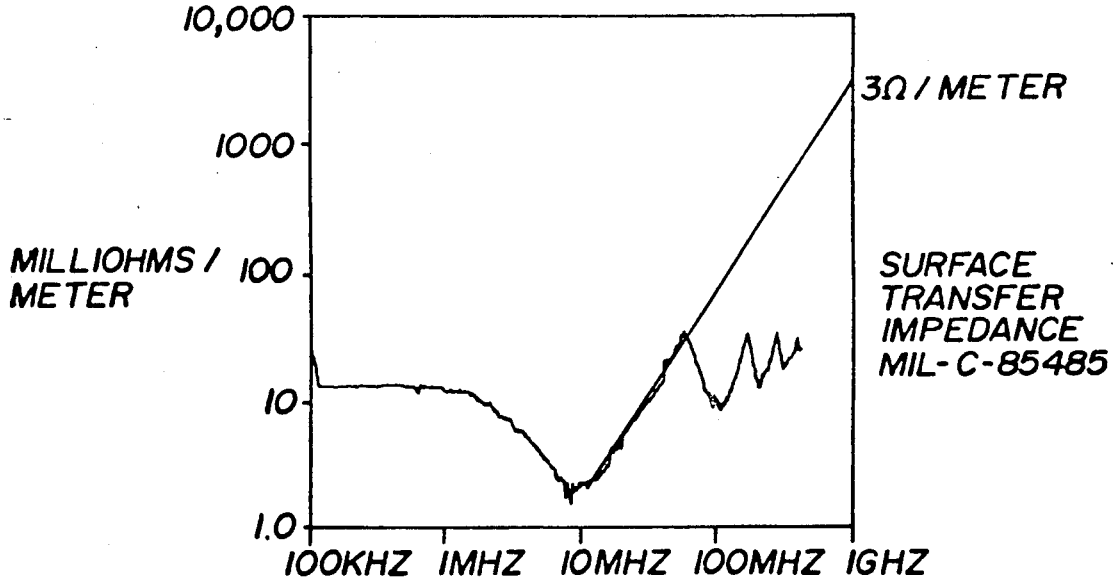
FIGS. 2 through 5 represent graphical representations of shielding data obtained for various shielded wire and cable articles fabricated in accordance with the invention, and compared with standard wire braided shield articles.

A reference or standard shielded wire construction was utilized for comparison with the shielded wire and cable articles of the invention. The reference shielded cable consisted of an RG 302 cable having a silver-plated copper solid conductor core of AWG 22 (OD=0.025") overlaid with a polyethylene insulation layer (OD=0.143"). A shield layer was overlaid the polyethylene insulation layer. The shield layer comprised a silver-plated copper braid (92% coverage). The transfer impedance for this shielded wire is illustrated in FIG. 2. This shielded wire has a typical extrapolated transfer impedance of 3 ohm/meter at 1 GHz.

A shielded cable was fabricated in accordance with the present invention by wrapping a polyaniline-based conducting polymer film, formulated by Americhem-/Allied Signal Corp., about the silver-plated copper braid of the above RG 302 cable. The conductive polymer layer was approximately 7 mil thick and had a conductivity of approximately 0.5 $(\text{ohm-cm})^{-1}$.

Figure 3:
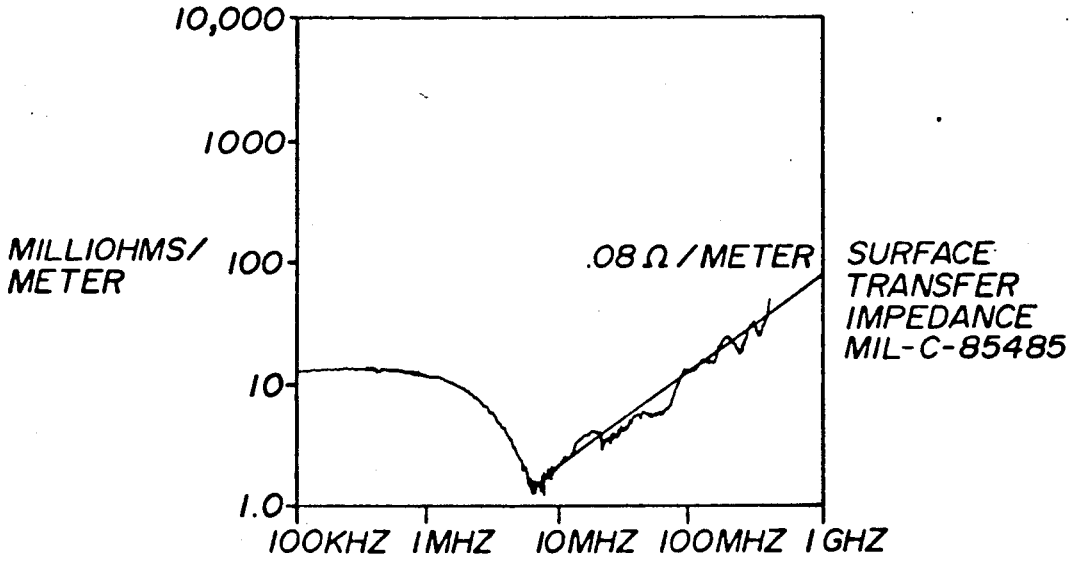

The transfer impedance obtained for the shielded cable of EXAMPLE 1 is shown in FIG. 3. The results are comparable to those depicted for the RG 302 cable in FIG. 2 up to about 8 MHz. Above the 8 MHz level, it will be observed that the transfer impedance for the inventive cable is lowered significantly. The shielded cable invention has an extrapolated value of about 0.08 ohm/meter. Resonance effects at the higher frequencies can be observed as being much smaller due to the improved shielding of the invention, than that of the standard shielded cable article.

EXAMPLE 2

Figure 4:
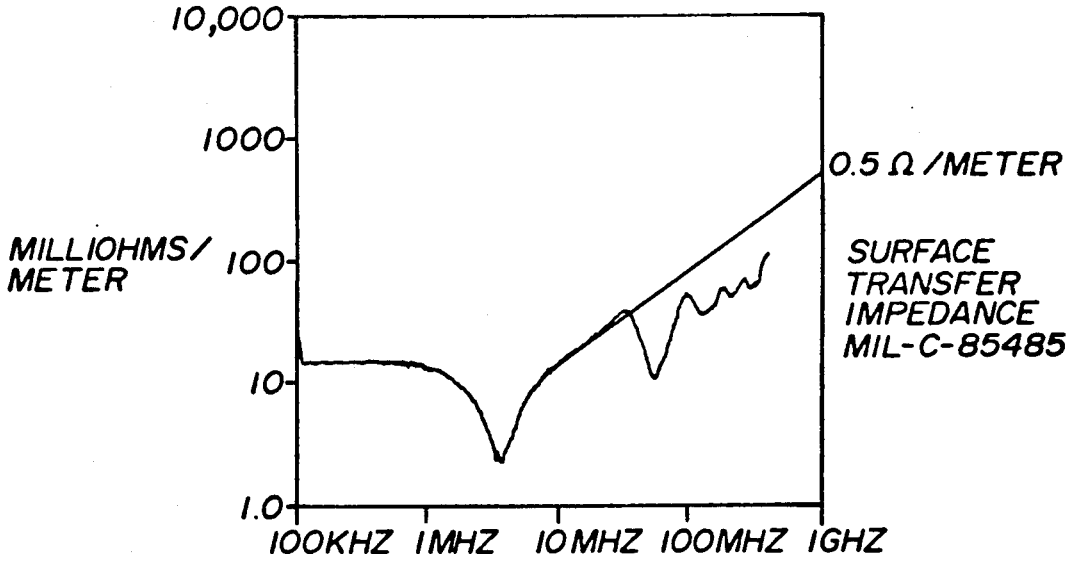

A second cable was fabricated utilizing polypyrrole sheets provided by BASF. The sheets were slit into tapes, and then wrapped around the reference cable of EXAMPLE 1. The thickness of the jacket (polymer shield layer) was approximately 5 mil thick. The conductivity of this layer was approximately 10 $(\text{ohm-cm})^{-1}$. The observed transfer impedance for this cable is shown in FIG. 4. Above the 4 MHz level, the impedance is seen to increase at a slower rate (slope) than that shown for the reference cable. This indicates that there is improved shielding. The extrapolated value for the transfer impedance is approximately 0.5 ohm/meter at 1 GHz. The smaller resonance effects at the higher frequencies are clearly observed and are due to the addition of the polypyrrole wrap. The impedance is higher than that illustrated in FIG. 2, resulting from the fact that the polypyrrole layer was not tightly wrapped on the braided mesh, due to its inherent brittleness.

EXAMPLE 3

Figure 5:
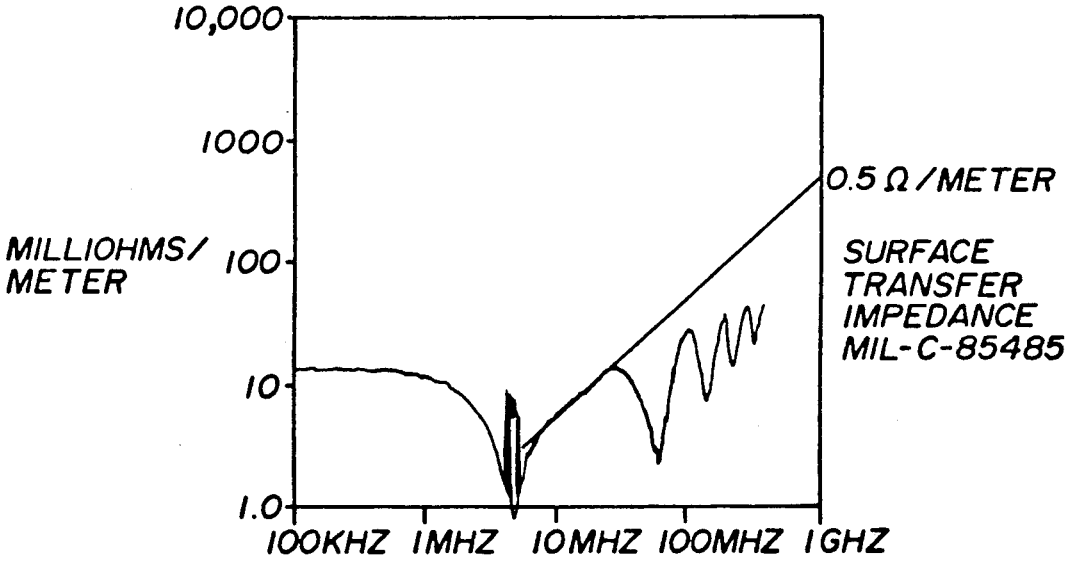

A cable was fabricated with the construction similar to that described in EXAMPLES 1 and 2, with the exception that the jacket layer (conductive polymer) was replaced with a metal filled polymer. A 10 mil thick tape of ethylenetetrafluoroethylene copolymer filled with zinc was used. The volume conductivity was observed to be approximately 0.1 $(\text{ohm-cm})^{-1}$. The transfer impedance results are illustrated in FIG. 5.

Above the 5 MHz level, the impedance is shown increasing at a slower rate than the reference. The extrapolated value at 1 GHz is approximately 0.5 ohm/meter. However, the high frequency response is similar to that of the reference cable.

It is apparent from the observed data that conductive polymers provide enhanced shielding effectiveness in the EMI region when combined with the conventional wire mesh braided cable. Filled polymers that have similar or lower volume conductivities than inherently intrinsically conductive polymers, behave in a similar manner to the reference braided shield at high frequencies. The conductivity of the filled polymers will depend upon the shear rate when extruded directly upon the mesh.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented by the subsequently appended claims.

What is claimed is:

1. A wire or cable article having enhanced shielding effectiveness, particularly in the EMI frequency region, comprising:

a conductive core member;

at least one layer of insulation disposed over said conductive core member;

a layer of shield material consisting of a metallic braided or served mesh provided as a protective shield layer disposed over the insulated conductive core member; and a jacket over said protective shield layer comprising at least one layer of an inherently and intrinsically conductive polymer material, and wherein transfer impedance of said wire or cable is in an approximate range of 0.05 to 0.5 ohm/meter at a frequency in a respective range of approximately between 5 Mhz and 1 GHz.

2. The wire or cable article in accordance with claim 1, wherein said jacket material comprises inherently and intrinsically conductive polymers selected from a group consisting of polypyrrole, and a polyaniline-based conducting polymer.

3. The wire or cable article in accordance with claim 1, further comprising a conductive polymer layer disposed below said braided or served mesh.

4. The wire or cable article in accordance with claim 1, wherein there are at least two conductive polymer shield layers disposed about said layer of braided or served mesh, one of which comprises said jacket layer.

5. The wire or cable article in accordance with claim 1, wherein said wire or cable article comprises a coaxial cable, and further wherein said conductive core member comprises at least one metallic wire.

6. The wire or cable article in accordance with claim 1, wherein said conductive core member comprises a plurality of metallic wires that are straight, braided or twisted.

7. The wire or cable article in accordance with claim 1, wherein said conductive core member comprises a plurality of metallic wires that are individually insulated.

8. The wire or cable article in accordance with claim 1, that is formed into a twin pair of cables.

9. The wire or cable article in accordance with claim 1, wherein said conductive core member comprises a multicore member.

10. A wire or cable article having enhanced shielding effectiveness, particularly in the EMI frequency region, comprising:

a conductive core member;

at least one layer of insulation disposed over said conductive core member;

a layer of shield material consisting of a metallic braided or served mesh provided as a protective shield layer disposed over the insulated conductive core member; and at least one layer disposed adjacent said protective shield layer comprising at least one layer of an inherently and intrinsically conductive polymer such as a polyaniline-based conducting polymer material.

11. The wire or cable article in accordance with claim 10, wherein said layer disposed adjacent said protective shield layer comprises an overlaid jacket of material.

12. The wire or cable article in accordance with claim 11, wherein said layer disposed adjacent said protective shield layer comprises an overlaid jacket of material comprising inherently and intrinsically conductive polymers selected from a group consisting of polypyrrole, and a polyaniline-based conducting polymer.

13. The wire or cable article in accordance with claim 10, wherein said layer disposed adjacent said protective shield layer comprises an underlayer of material.

14. The wire or cable article in accordance with claim 13, wherein said underlayer disposed adjacent said protective shield layer comprises material of a conductive polymer selected from a group consisting of polypyrrole, and a polyaniline-based conducting polymer.

15. The wire or cable article in accordance with claim 10, wherein there are at least two conductive polymer shield layers, each of which is disposed about said layer of braided or served mesh and wherein one of which comprises a jacket layer.

16. The wire or cable article in accordance with claim 10, wherein transfer impedance of said wire or cable is in an approximate range of 0.05 to 0.5 ohm/meter at a frequency in a respective range of approximately between 5 MHz and 1 GHz.

17. The wire or cable article in accordance with claim 10, wherein said conductive core member comprises at least one metallic wire.

18. The wire or cable article in accordance with claim 10, wherein said conductive core member comprises a plurality of metallic wires that are straight, braided or twisted.

19. The wire or cable article in accordance with claim 10, wherein said conductive core member comprises a plurality of metallic wires that are individually insulated.

20. The wire or cable article in accordance with claim 10, that is formed into a twin pair of cables.

21. The wire or cable article in accordance with claim 10, wherein said conductive core member comprises a multicore member.

22. The wire or cable article in accordance with claim 10, wherein the conductive polymer layer is disposed beneath said shield layer.

* * * * *